US007721535B2

(12) United States Patent
Ruth et al.

(10) Patent No.: US 7,721,535 B2
(45) Date of Patent: May 25, 2010

(54) METHOD FOR MODIFYING TRIGGER LEVEL FOR ADSORBER REGENERATION

(75) Inventors: Michael J. Ruth, Franklin, IN (US); Michael J. Cunningham, Greenwood, IN (US)

(73) Assignee: Cummins Inc., Columbus, IN (US)

( * ) Notice: Subject to any disclaimer, the term of this patent is extended or adjusted under 35 U.S.C. 154(b) by 471 days.

(21) Appl. No.: 11/636,184

(22) Filed: Dec. 8, 2006

(65) Prior Publication Data

US 2007/0240407 A1 Oct. 18, 2007

Related U.S. Application Data

(63) Continuation of application No. PCT/US2005/019850, filed on Jun. 6, 2005.

(60) Provisional application No. 60/578,015, filed on Jun. 8, 2004.

(51) Int. Cl.
*F01N 3/00* (2006.01)

(52) U.S. Cl. ..... 60/295; 60/274; 60/286; 60/297; 60/301; 60/303

(58) Field of Classification Search ..... 60/274, 60/277, 285, 286, 295, 297, 301, 303
See application file for complete search history.

(56) References Cited

U.S. PATENT DOCUMENTS

| | | | |
|---|---|---|---|
| 5,473,887 | A | 12/1995 | Takeshima et al. |
| 5,743,084 | A | 4/1998 | Hepburn |
| 5,784,879 | A | 7/1998 | Dohta et al. |
| 5,894,725 | A | 4/1999 | Cullen et al. |
| 6,216,449 | B1 | 4/2001 | Strehlau et al. |
| 6,244,046 | B1 | 6/2001 | Yamashita |
| 6,308,515 | B1 | 10/2001 | Bidner et al. |
| 6,311,482 | B1 | 11/2001 | Yamashita |
| 6,327,847 | B1 | 12/2001 | Surnilla et al. |
| 6,327,848 | B1 | 12/2001 | Poggio et al. |
| 6,345,498 | B2 | 2/2002 | Yonekura et al. |
| 6,360,530 | B1 | 3/2002 | Robichaux et al. |
| 6,370,868 | B1 | 4/2002 | Kolmanovsky et al. |
| 6,374,597 | B1 | 4/2002 | Bidner et al. |
| 6,389,802 | B1 | 5/2002 | Berger et al. |
| 6,422,003 | B1 | 7/2002 | Ament et al. |
| 6,427,439 | B1 | 8/2002 | Xu et al. |
| 6,434,928 | B1 | 8/2002 | Manaka |

(Continued)

FOREIGN PATENT DOCUMENTS

| | | |
|---|---|---|
| WO | WO 99/35386 | 7/1999 |

OTHER PUBLICATIONS

Search Report EP 05784978, Sep. 25, 2008, Cummins Inc.

*Primary Examiner*—Binh Q. Tran
(74) *Attorney, Agent, or Firm*—Krieg DeVault LLP; J. Bruce Schelkopf, Esq.

(57) ABSTRACT

A method for modifying a $NO_x$ adsorber regeneration triggering variable. Engine operating conditions are monitored until the regeneration triggering variable is met. The adsorber is regenerated and the adsorbtion efficiency of the adsorber is subsequently determined. The regeneration triggering variable is modified to correspond with the decline in adsorber efficiency. The adsorber efficiency may be determined using an empirically predetermined set of values or by using a pair of oxygen sensors to determine the oxygen response delay across the sensors.

27 Claims, 6 Drawing Sheets

U.S. PATENT DOCUMENTS 6,438,944 B1 8/2002 Bidner et al.
6,451,602 B1 9/2002 Popoff et al.
6,453,663 B1 9/2002 Orzel et al.
6,463,733 B1 10/2002 Asik et al.
6,467,259 B1 10/2002 Surnilla et al.
6,477,832 B1 11/2002 Surnilla et al.
6,481,199 B1 11/2002 Bidner et al.
6,487,849 B1 12/2002 Bidner et al.
6,487,850 B1 12/2002 Bidner et al.
6,487,853 B1 * 12/2002 Hepburn et al. ..... 60/295
6,490,858 B2 12/2002 Barrett et al.
6,490,860 B1 12/2002 Farmer et al.
6,497,092 B1 * 12/2002 Theis ..... 60/274
6,502,387 B1 1/2003 Asik et al.
6,651,422 B1 * 11/2003 LeGare ..... 60/277
6,684,631 B2 * 2/2004 Surnilla et al. ..... 60/285
6,708,483 B1 * 3/2004 Robichaux et al. ..... 60/286
6,871,492 B2 3/2005 Huynh et al.
6,889,497 B2 5/2005 Schnaibel et al.
7,111,451 B2 * 9/2006 Dou et al. ..... 60/285
2002/0026790 A1 3/2002 Shimotani
2002/0189580 A1 12/2002 Surnilla et al.
2002/0194836 A1 12/2002 Asik et al.
2003/0000205 A1 1/2003 Lewis et al.
2003/0037541 A1 2/2003 Farmer et al.

* cited by examiner

METHOD FOR MODIFYING TRIGGER LEVEL FOR ADSORBER REGENERATION

RELATED APPLICATIONS

The present application is a continuation of PCT Patent Application No. PCT/US2005/019850 filed Jun. 6, 2005, which claims the benefit of U.S. Provisional Patent Application No. 60/578,015 filed Jun. 8, 2004, and entitled METHOD FOR MODIFYING TRIGGER LEVEL FOR ADSORBER REGENERATION, each of which is incorporated herein by reference.

STATEMENT REGARDING FEDERALLY SPONSORED RESEARCH OR DEVELOPMENT

The U.S. Government has certain rights in the present invention as provided by the terms of contract no. DE-FC05-97OR22533 awarded by the U.S. Department of Energy.

BACKGROUND

The present invention relates generally to the regeneration of a nitrogen-oxygen compound (NOx) adsorber catalyst. More particularly, the present invention relates to a method of controlling the frequency of $NO_x$ adsorber regeneration cycles by modifying a regeneration-triggering variable based on an engine operating condition.

Environmental concerns have led to increasingly stricter regulation of engine emissions by governmental agencies. The reduction of $NO_x$ in exhaust emissions from internal combustion engines has become increasingly important in order to meet governmental regulations. It is widely recognized that this trend of stricter government regulation will continue.

Traditional in-cylinder emission reduction techniques such as exhaust gas recirculation and injection rate shaping, by themselves will not be able to achieve the desired low emission levels. Scientists and engineers recognize that aftertreatment technologies will have to be used, and will have to be further developed in order to meet the future low emission requirements of the diesel engine. Abatement of $NO_x$ on motor vehicles may be achieved through the use of catalytic technology that converts the NOx species to diatomic nitrogen ($N_2$) using a reductant as shown in the following equation:

$$NO_x + \text{reductant} \xrightarrow{\text{catalyst}} N_2 + H_2O + CO_2$$

Removal of $NO_x$ through the use of $NO_x$ adsorber catalysts requires that a hydrocarbon reductant be provided to the catalyst to convert the $NO_x$. Typically, on-board fuel (e.g., diesel fuel) is used as the reductant. Fuel is injected into the exhaust stream for reaction with $NO_x$ on the catalyst.

Therefore, a need exists for further technological advancements in emission control systems for internal combustion engines. The present invention is directed toward meeting this need.

SUMMARY

One aspect of the present invention contemplates a method comprising: operating an internal combustion engine including an after-treatment system having a $NO_x$ adsorber catalyst, the engine includes an engine operating condition threshold value for triggering a regeneration of the $NO_x$ adsorber catalyst; determining a change in the $NO_x$ adsorber catalyst; and adjusting the engine operating condition threshold value for triggering a regeneration of the $NO_x$ adsorber catalyst based upon the determining act.

Another aspect of the present invention contemplates a method comprising: operating a diesel engine having an after-treatment system including a $NO_x$ adsorber catalyst; triggering a $NO_x$ adsorber catalyst regeneration cycle based on a fuel consumption threshold value; determining the decrease in the $NO_x$ adsorber catalyst efficiency over a plurality of the $NO_x$ adsorber catalyst regeneration cycles; and modifying the fuel consumption threshold value in response to the determining act.

Yet another aspect of the present invention contemplates a system comprising: a diesel engine that consumes a fuel and produces an exhaust gas; a $NO_x$ adsorber in fluid communication with the exhaust gas for adsorbing at least a portion of the exhaust gas; a first value to trigger a first regeneration cycle of the $NO_x$ adsorber; a control system to determine the decline in absorbtion efficiency of the $NO_x$ adsorber and to output a second value corresponding to the decline in absorbtion efficiency of the $NO_x$ adsorber; and a control to calculate a third value based upon the first value and the second value, the third value triggers a second regeneration cycle of the $NO_x$ adsorber, in each of the regeneration cycles a reductant is delivered to the $NO_x$ adsorber.

A further aspect of the present invention contemplates a method comprising: operating a vehicle including an internal combustion engine, the internal combustion engine including an after-treatment system with an adsorber catalyst; determining if the internal combustion engine has a load greater than a first threshold; determining if the internal combustion engine is participating in an aggressive driving situation; and regenerating the adsorber catalyst only when the engine is not participating in an aggressive driving situation nor subject to a load greater than the first threshold.

DESCRIPTION OF THE SELECTED EMBODIMENTS

Figure 1:
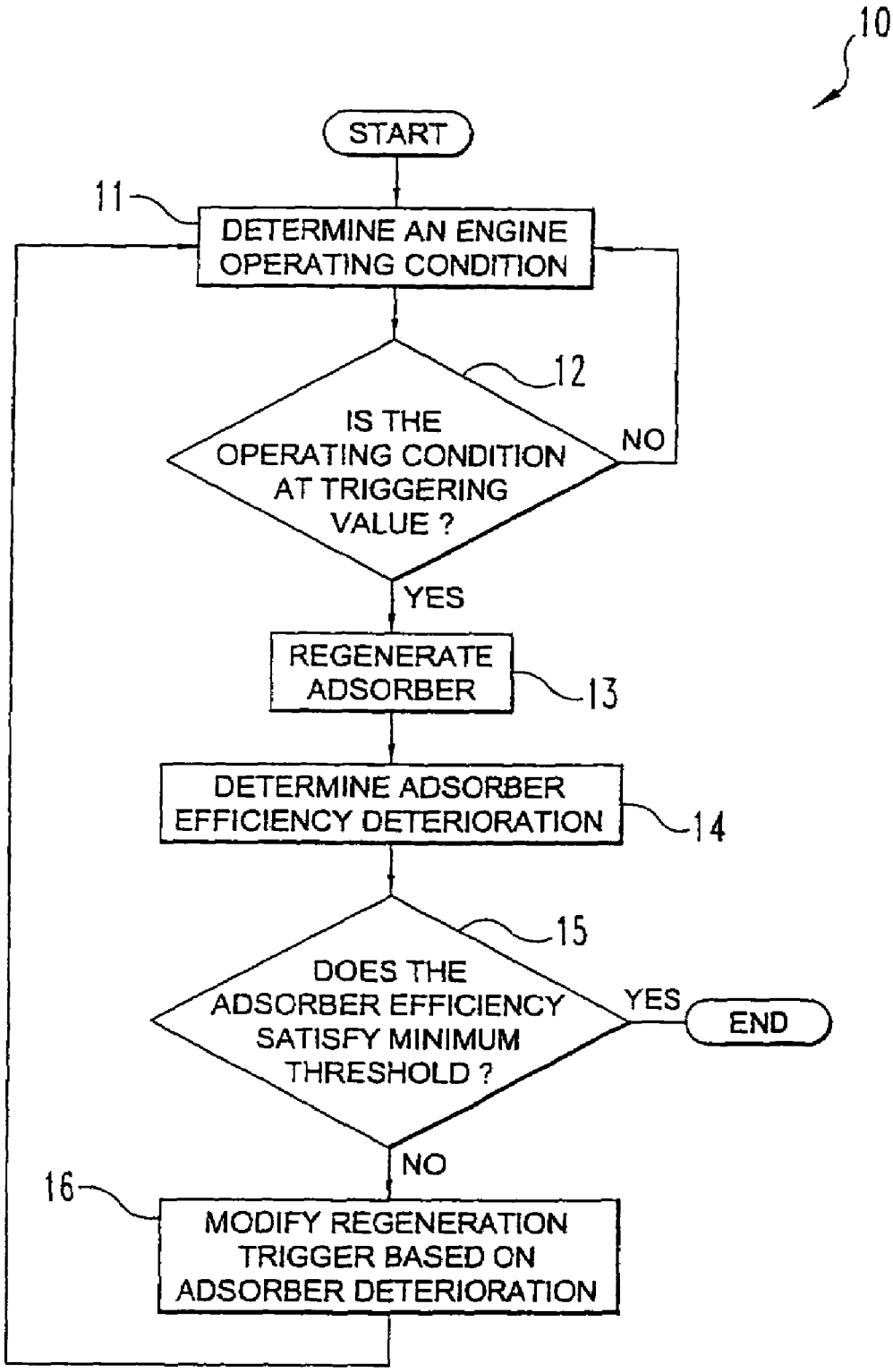
FIG. 1 is a flow chart illustrating an algorithm disclosing one embodiment of the present invention.

For the purposes of promoting understanding of the principles of the invention, reference will be made to the embodiments illustrated in the drawings and specific language will be used to describe the same. It will nevertheless be understood that no limitation of the scope of the invention is hereby intended and alterations and modifications in the illustrated device, and further applications of the principles of the present invention as illustrated herein being contemplated as would normally occur to one skilled in the art to which the invention relates.

The present application recognizes that one of the more complex problems in regenerating $NO_x$ adsorber catalysts by periodically injecting reductants is that the adsorption efficiency of the catalyst deteriorates over time. As this occurs, the amount of $NO_x$ adsorbed decreases after each regeneration cycle. Soon the injection timing and the amount of reductant injected may not properly track the amount of $NO_x$ adsorbed on the catalyst. This failure to properly track the regeneration needs of the $NO_x$ adsorber catalyst leads to increased $NO_x$ emissions due to the failure of the $NO_x$ adsorber to adsorb. Furthermore, reductant is wasted as amounts are released when unneeded. The present application provides methods to maintain the performance of the system as the catalyst deteriorates.

Referring to FIG. 1, there is illustrated an algorithm 10 that generally describes one method of the present invention. Trigger modification algorithm 10 begins at block 11 with determining an engine operating condition. The present invention preferably utilizes the amount of fuel consumed as the engine operating condition. However, other engine operating conditions may be used, including the number of engine cycles or engine air mass flow. At block 12 a decision is made whether the engine operating condition has met the regeneration triggering value. If the regeneration triggering value has not been met, then the algorithm returns to determining an engine operating condition in block 11. If the engine operating condition has reached the regeneration triggering value, then a regeneration of the adsorber is indicated at block 13.

After the adsorber is regenerated, the deterioration of adsorber efficiency is determined at block 14. The deterioration of the adsorber efficiency may be determined by utilizing an open-loop empirical data table including a deterioration schedule residing in a controller or using a pair of sensors to provide a closed-loop assessment of the adsorber condition. In one form of the present invention the pair of sensors are oxygen sensors, however in another form the pair of sensors are $NO_x$ sensors The $NO_x$ sensors look at a direct measurement of the $NO_x$. At block 15, this adsorber efficiency is compared to a minimal threshold value. If the minimal threshold value is satisfied, then the algorithm ends. If not, the algorithm moves on to block 16 where the regeneration triggering value is modified based on the amount of deterioration of the adsorber. The algorithm then uses the new regeneration triggering value upon returning to the beginning of the algorithm at block 11.

Figure 2:
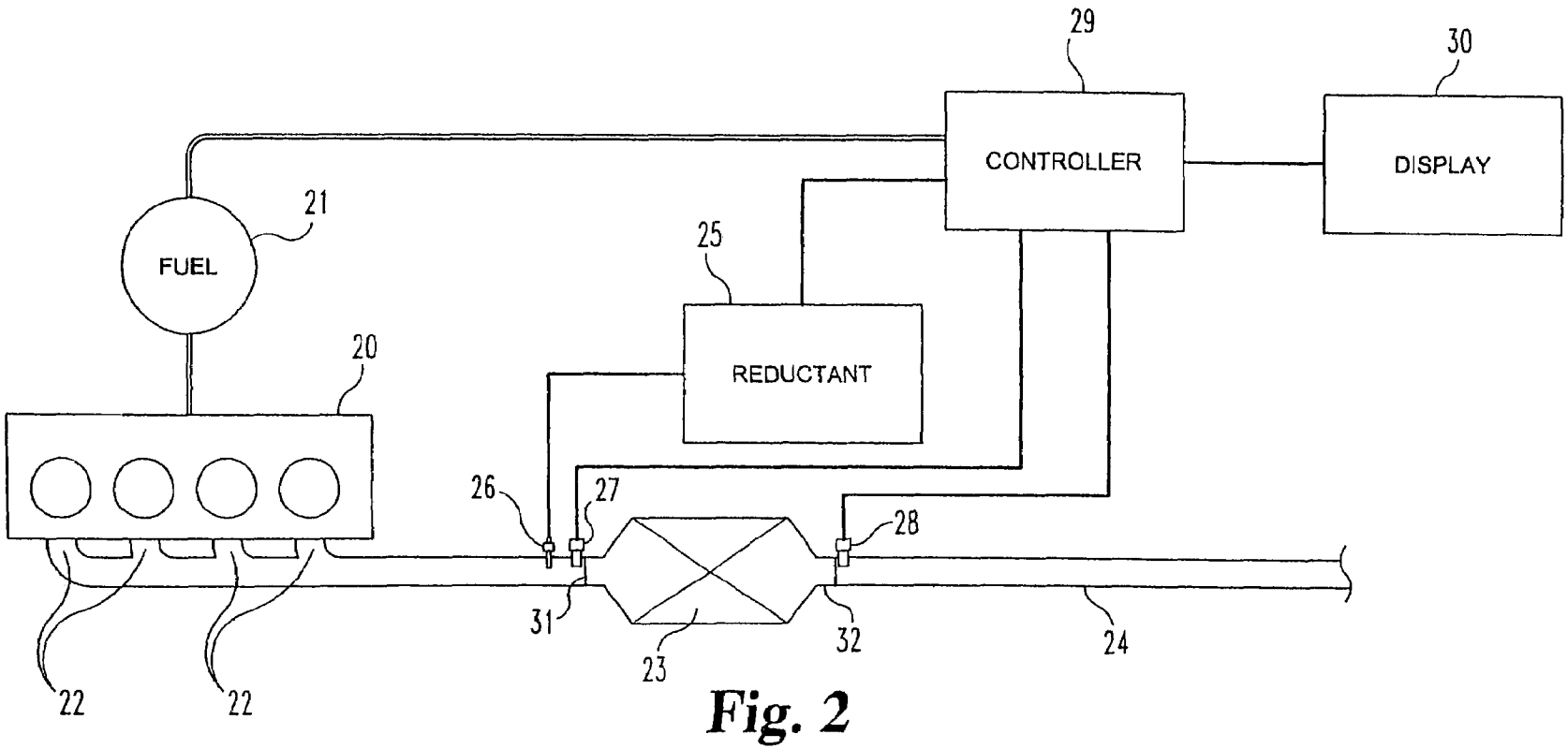
FIG. 2 is a schematic illustration of a system comprising another embodiment of the present invention.

Referring to FIG. 2, there is illustrated a schematic diagram of one embodiment of the present invention. Engine 20 is connected to a fuel source 21 that provides fuel to be combusted inside engine 20. The engine illustrated is purely schematic and no intention is made to limit the engine based on the figure. The engine can, but is not limited to an inline or V-engine with one or a plurality of cylinders, and can be a spark ignition or a compression ignition engine. Further, the engine can be gaseous or liquid fueled. Exhaust gas exits the engine at exhaust gas outlet 22 and passes through exhaust pipe 24 to $NO_x$ adsorber 23 before continuing through the exhaust pipe 24 to the ambient atmosphere. The housing including the $NO_x$ adsorber 23 includes an inlet 31 and an outlet 32. Reductant is applied from reductant providing source 25 and injected into the exhaust gas pipe 24 through injector 26. In a preferred form, the source of reductant is the fuel source 21, which is coupled in flow communication with the injector 26. In another form of the present application the reductant is delivered directly in-cylinder by the engine fuel injection system. Further, the present application contemplates that other methods known to one skilled in the art of providing the reductant to the inlet 31 of $NO_x$ adsorber 23.

An inlet oxygen sensor 27 measures the oxygen content of the exhaust gas at inlet 31 and an outlet oxygen sensor 28 measures the oxygen content of the exhaust gas at outlet 32. Controller 29 receives an input corresponding to the amount of fuel consumed by engine 20 from fuel source 21. A signal from fuel source 21 to controller 29 is used in determining the amount of fuel consumed. In one form of the present application the amount of fuel consumed is calculated. Preferably, but without limiting the present application the amount of fuel consumed is a summation of discrete values. Moreover, outputs from first oxygen sensor 27 and second oxygen sensor 28 are input into the controller 29. Controller 29 then determines the time for supplying reductant and the amount of reductant to be supplied through injector 26 to $NO_x$ adsorber inlet 31. Controller 29 then sends an output signal to the reductant providing source 25. While, the present application has been described in terms of two oxygen sensors it is also contemplated to utilize the output from a pair of $NO_x$ sensors.

Reductant providing source 25 may further include a pump to provide a pressurized amount of reductant to injector 26. In one form the system includes an auxiliary pump to pressurize the reductant. As discussed above in another form of the present invention the reductant is delivered in cylinder by the engine fuel injection system. The reductant providing source can be the fuel source 21 that can be placed in fluid flow communication with injector 26. Further, other methods known to one skilled in the art for supplying reductant to the $NO_x$ adsorber are contemplated herein. If inputs from first oxygen sensor 27 and second oxygen sensor 28 indicate that the efficiency of the adsorber has dropped below a minimum level then an output signal is sent to display 30 to indicate that the catalyst has malfunctioned. A malfunction may result in further activities such as a desulfurizing event or replacement of the catalyst.

Figure 3:
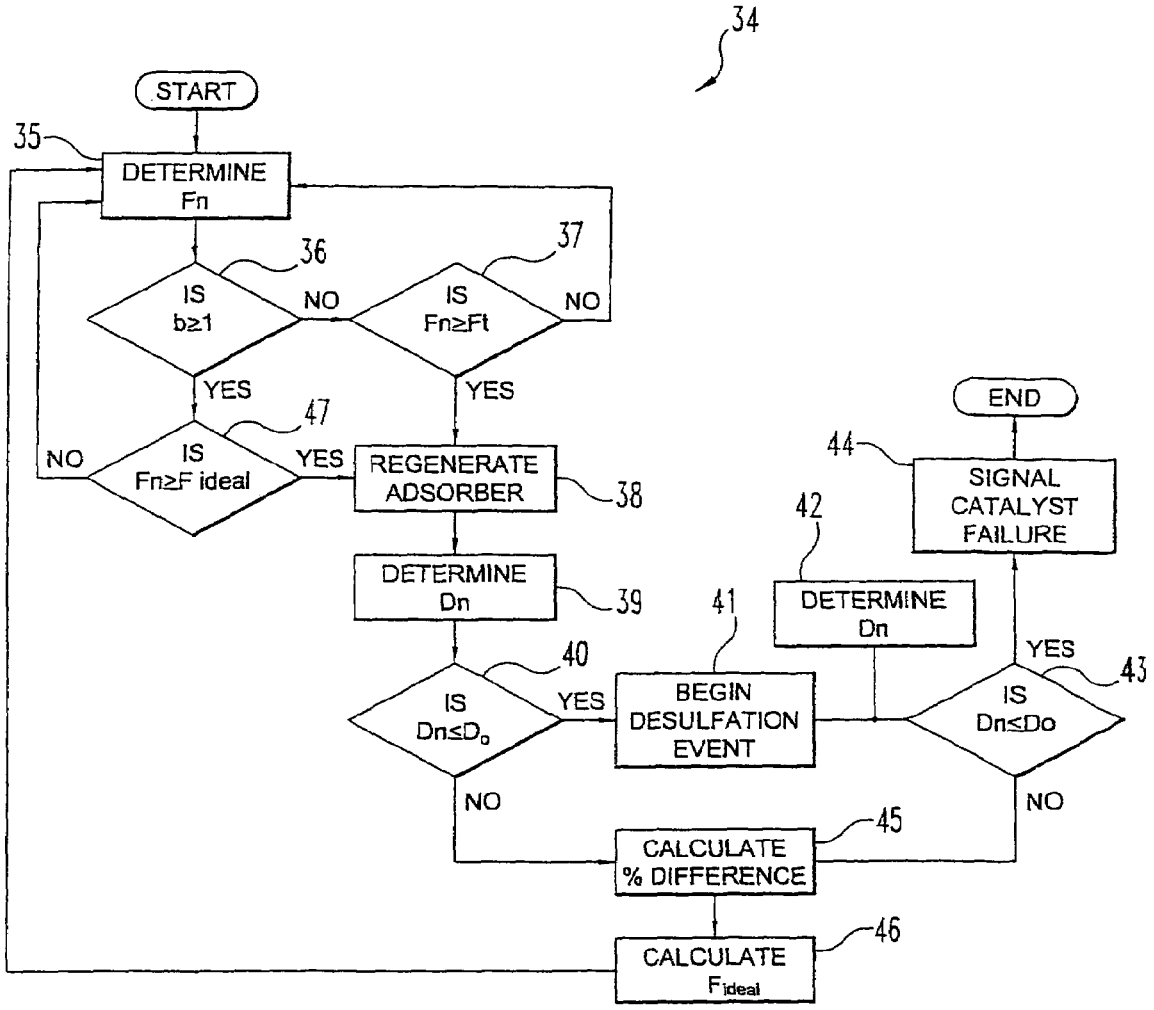
FIG. 3 is a flow chart illustrating one embodiment of an algorithm to control the system depicted in FIG. 2.

Referring to FIG. 3, there is illustrated one embodiment of a trigger modification algorithm 34 for controlling the system set forth in FIG. 2. Algorithm 34 begins at block 35 by determining the present fuel consumption of the engine. The present fuel consumption value of the engine is depicted in FIG. 3 as symbol $F_n$. Block 36 then determines if at least one regeneration cycle has been performed. The number of regeneration cycles is indicated in FIG. 3 as symbol b. If there has not been at least one regeneration cycle performed, then the algorithm moves to block 37. At block 37, the present fuel consumption value is compared to the regeneration triggering fuel consumption value. The regeneration triggering fuel consumption value is depicted in FIG. 3 as symbol $F_t$. If the fuel consumption value is greater than or equal to the regeneration triggering fuel consumption value, then adsorber regeneration is indicated at block 38. If the present fuel consumption value is less than the regeneration triggering fuel consumption value, then the control system returns to determine a new present fuel consumption value.

After regeneration of $NO_x$ adsorber 23 at block 38, inputs from the first oxygen sensor 27 and second oxygen sensor 28 allow the controller to determine a first characteristic across the sensors. In one form of the invention the first characteristic is delay time, however other characteristics are contemplated herein. This is symbolized in block 39 as $D_n$. The algorithm then moves to block 40 and determines if the actual delay time is less than or equal to a minimum delay time threshold value symbolized as $D_o$. If the actual delay time is less than or equal to this minimum delay time threshold value, then a desulfation event is begun as indicated by block 41. After the desulfation event at block 41, the algorithm then moves to block 42 and determines the actual delay time across the oxygen sensors again. At block 43 the algorithm determines if the actual delay time across the oxygen sensors is still less than or equal to the minimum delay time threshold value. If true, a catalyst malfunction/failure signal is indicated at block 44. The algorithm ends after the failure signal is made.

In contrast, if the delay across the sensors is determined at block 40 or 43 to be greater than the minimum delay time threshold value $D_o$ then the algorithm proceeds to block 45 to calculate the percent difference. The percent difference is calculated by first subtracting the actual delay time from a predetermined base delay time and then dividing that difference by the predetermined base delay time. This value is then multiplied by one hundred to determine the percent difference. The predetermined base delay time corresponds to the delay time across a fresh $NO_x$ adsorber. At block 46, the algorithm then calculates the modified fuel consumption trigger value. The modified fuel consumption trigger value is symbolized as $F_{ideal}$. $F_{ideal}$ is a function of a scalable constant $a_1$, the regeneration triggering fuel consumption value $F_t$ and the percent difference. The scalable constant $a_1$ is derived empirically for each class of engines and for each particular adsorber.

After $F_{ideal}$ is calculated in block 46, the algorithm returns to block 35, and the present fuel consumption is determined again. The number of regeneration cycles now is at least one, because one regeneration cycle has occurred. Therefore, the algorithm moves to block 47 where the present fuel consumption is now compared to see if it is greater than or equal to the modified fuel consumption trigger value. This is depicted at block 47 as $F_n$ is greater than or equal to $F_{ideal}$. If true, then adsorber regeneration is indicated and the algorithm passes to block 38. If not, the algorithm returns and the fuel consumption value is determined again at block 35.

Figure 4:
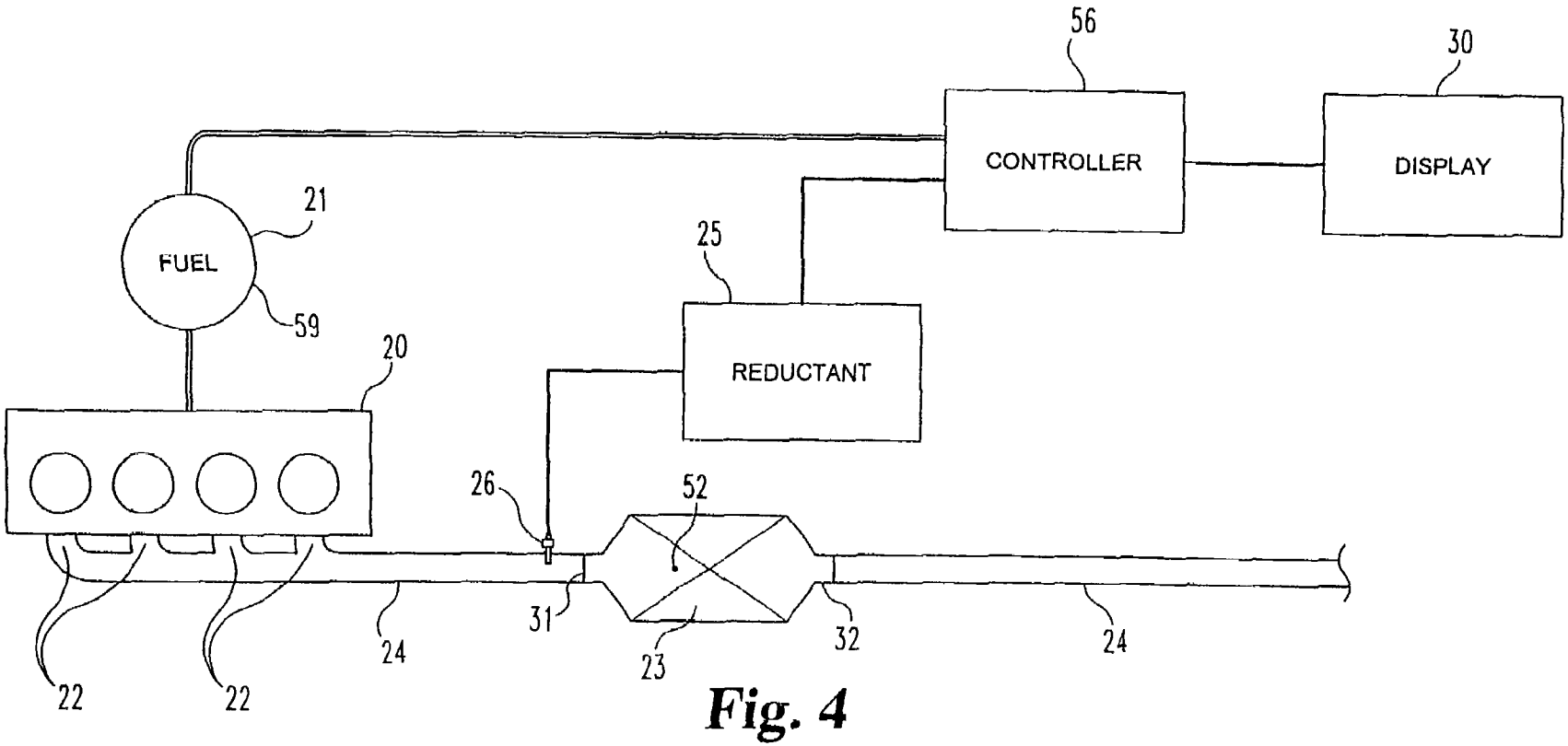
FIG. 4 is a schematic illustration of a system comprising another embodiment of the present invention.

Referring to FIG. 4, there is illustrated a schematic of another embodiment of the present invention. The reader will note that like feature numbers will be utilized to describe the features that were described previously. As discussed above, the reductant can also be delivered directly in-cylinder. Engine 20 produces exhaust gas containing contaminants such as $NO_x$ that exit engine outlet 22 and pass through $NO_x$ adsorber 23. Reductant providing source 25 provides reductant to be injected into exhaust pipe 24 to help regenerate the $NO_x$ adsorber catalyst in the $NO_x$ adsorber 23.

Controller 56 includes an empirically determined table of constants to modify the predetermined fuel trigger value in accordance to the number of regeneration cycles already performed. Once the controller determines a regeneration cycle is indicated, an output signal is sent to reductant providing source 25 to inject reductant into exhaust gas pipe line 24 through the use of injector 26. As discussed above, the reductant providing source can be the fuel source 21, which will be, placed in fluid flow communication with injector 26. If controller 56 determines that the number of regeneration cycles performed indicates that the efficiency of $NO_x$ adsorber 23 has likely dropped below a predetermined minimum threshold, then an output signal is sent to display 30 to indicate the failure of $NO_x$ adsorber 23.

Figure 5:
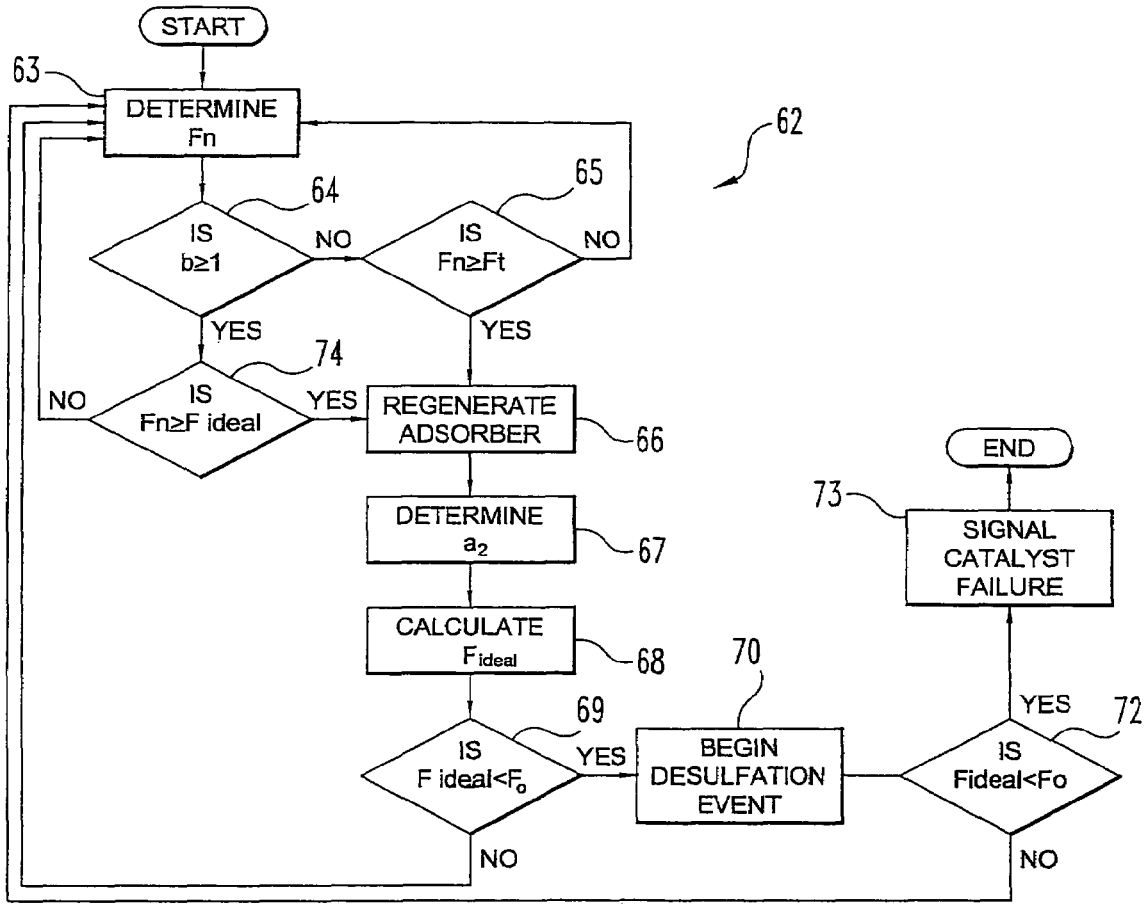
FIG. 5 is a flow chart illustrating one embodiment of an algorithm to control the system depicted in FIG. 4.

Referring to FIG. 5, there is illustrated one embodiment of trigger modification algorithm 62 for controlling the system set forth in FIG. 4. Algorithm 62 begins at block 63 by determining the present fuel consumption of the engine. The present fuel consumption of the engine is symbolized as $F_n$. The algorithm then moves to block 64 to determine if at least one regeneration cycle has been performed. The number of regeneration cycles is symbolized in FIG. 5 as b. If there has not been at least one regeneration cycle, then the algorithm passes to block 65 where the present fuel consumption value is compared to the regeneration triggering fuel consumption value. The regeneration triggering fuel consumption value is symbolized in FIG. 5 as $F_t$. If the present fuel consumption value does meet the regeneration triggering fuel consumption value, then adsorber regeneration is indicated at block 66. If the condition is not satisfied, the algorithm returns to block 63 to determine the present fuel consumption value.

After adsorber regeneration is indicated and performed, the algorithm determines the empirically derived modification constant at block 67. The empirically derived modification constant is symbolized as $a_2$. The empirically derived modification constants are provided from the controller 56 which includes a table of modification constants. The algorithm then proceeds next to block 68 where the modified fuel consumption trigger value is determined. The modified fuel consumption trigger value is symbolized in FIG. 5 as $F_{ideal}$. $F_{ideal}$ is a function of empirically derived modification constant $a_2$ and regeneration triggering fuel consumption value $F_t$. After the modified fuel consumption trigger value is calculated, the algorithm moves to block 69 where the modified fuel consumption trigger value is compared to a minimum fuel trigger value. The minimum fuel trigger value is depicted symbolically as $F_o$. In one form the minimum fuel trigger valve is a fixed value or one that is obtained from a look-up table. In a preferred form the minimum fuel trigger values are empirically based and populate a table.

The algorithm moves to block 70 when the modified fuel consumption trigger value is less than or equal to the minimum fuel trigger value $F_o$. Block 70 indicates beginning a desulfation event. After this desulfation event has occurred, the algorithm then moves to block 72 where the comparison between the modified fuel consumption trigger value and the minimum fuel trigger value is performed once again. When block 72 determines that the modified fuel consumption trigger value is still less than the minimum fuel trigger value $F_o$ then the algorithm moves to block 73 to signal a catalyst failure to the display 30. Alternatively, the algorithm returns to block 63 to determine the present fuel consumption value when either block 69 or 72 indicates that the valve for $F_{ideal}$ is greater than the minimum fuel trigger value $F_o$.

Upon return to block 64, the number of regeneration cycles is now at least one and the algorithm moves to block 74. At block 74, the present fuel consumption value is compared to the modified fuel consumption trigger value $F_{ideal}$. If the present fuel consumption value is greater than or equal to the modified fuel consumption trigger value, adsorber regeneration is indicated at block 66. If not, the algorithm returns to block 63.

While the description above depicts a few embodiments of the invention, they are not considered illustrative of all potential embodiments of the present invention. For example, the $NO_x$ adsorber catalyst may consist of various alkali metals and precious metals and may contain some oxygen storage chemicals such as ceria. The oxygen sensors can be a switching type around stoichiometric, a wide range heated oxygen sensor (HEGO, WEGO) or a $NO_x$ sensor with an oxygen sensing signal. Any sensor that can detect changes in the air fuel ratio are envisioned.

Figure 6:
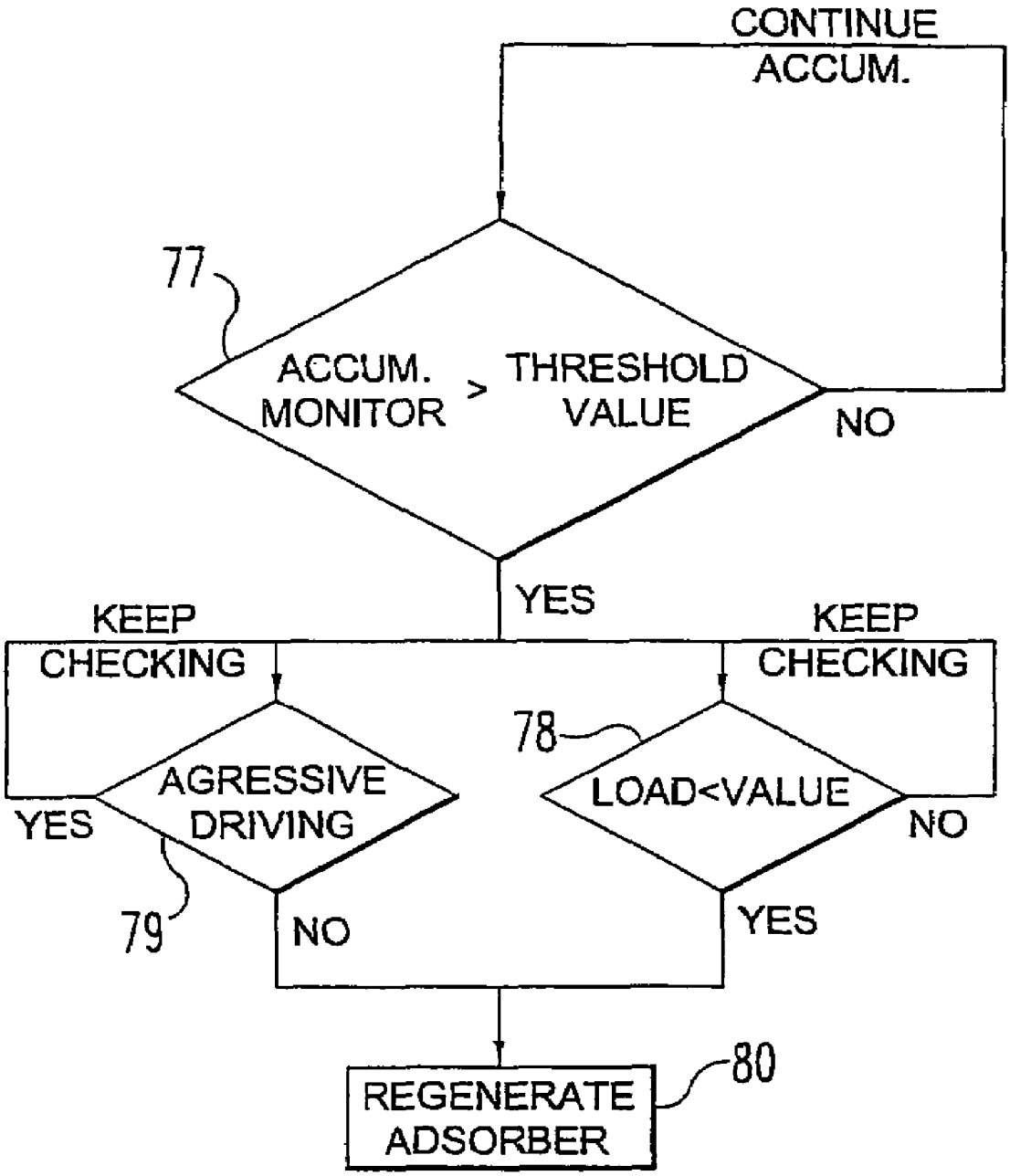
FIG. 6 is a flow chart illustrating one embodiment of an algorithm that prevents regeneration when engine-operating conditions are undesirable.

Referring to FIG. 6, there is illustrated one embodiment of an algorithm to postpone adsorber regeneration until an undesired operating condition has passed. The undesired operating condition may be, for example engine load or aggressive driving maneuvers. At block 77, an accumulation monitor continuously sums a mass based on a signal that is proportional to a species of concern, preferably fuel consumption. In some embodiments, the accumulation value is modified depending upon the level of deterioration in the catalyst. When the accumulation monitor reaches a threshold, a flag is set to determine if regeneration will be clear of the undesired engine operating condition. To insure fuel efficiency is maximized in aggressive driving situations, the engine load is monitored. Block 78 signals clearance to regenerate only when the engine load is below a predetermined value. In addition, at block 79, the algorithm checks for an aggressive driving situation and will not signal clearance to regenerate unless the aggressive drive situation is dampened. Blocks 78 and 79 will return indefinitely until their respective conditions are satisfied. Block 80 will then begin adsorber regeneration only when blocks 78 or 79 provide clearance signals.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention. Further, when the language "at least a portion" and/or "a portion" is used the item may include a portion and/or the entire item unless specifically stated to the contrary.

What is claimed is:

1. A method comprising:

operating an internal combustion engine including an after-treatment system having a $NO_x$ adsorber catalyst, the engine including a fuel consumption threshold value for triggering a regeneration of the $NO_x$ adsorber catalyst;

determining a $NO_x$ adsorber catalyst regeneration threshold adjustment value; and adjusting the fuel consumption threshold value for triggering a regeneration of the $NO_x$ adsorber catalyst based upon said $NO_x$ adsorber catalyst regeneration threshold adjustment value.

2. The method of claim 1, wherein said $NO_x$ adsorber catalyst regeneration threshold adjustment value comprises a $NO_x$ adsorber catalyst efficiency.

3. The method of claim 2, wherein said determining is an open loop operation.

4. The method of claim 2, wherein said determining comprises utilizing an open-loop empirical data table comprising a deterioration schedule.

5. The method of claim 2, wherein said determining is a closed loop operation.

6. The method of claim 5, wherein in said determining a pair of sensors are utilized, the sensors comprising one of oxygen sensors and $NO_x$ sensors.

7. The method of claim 1, which further includes triggering a regeneration of the $NO_x$ adsorber catalyst when the fuel consumption threshold value has been satisfied, wherein said triggering includes delivering a reductant to the $NO_x$ adsorber catalyst.

8. The method of claim 1, wherein in said determining the $NO_x$ adsorber catalyst regeneration threshold adjustment value is determined in response to whether an aggressive driving situation is present.

9. The method of claim 8, wherein in said determining the $NO_x$ adsorber catalyst regeneration threshold adjustment value is a value that prevents triggering a regeneration of the $NO_x$ adsorber catalyst in response to the determining that an aggressive driving situation is present.

10. A method comprising:

operating a diesel engine having an after-treatment system including a $NO_x$ adsorber catalyst;

triggering a $NO_x$ adsorber catalyst regeneration cycle based on a fuel consumption threshold value;

determining the decrease in the $NO_x$ adsorber catalyst efficiency over a plurality of the $NO_x$ adsorber catalyst regeneration cycles; and modifying the fuel consumption threshold value in response to said determining.

11. The method of claim 10, wherein said determining comprises utilizing an open-loop empirical data table comprising a deterioration schedule.

12. The method of claim 10, wherein said determining is a closed loop operation.

13. The method of claim 12, wherein in said determining a pair of sensors are utilized, the sensors comprising one of oxygen sensors and $NO_x$ sensors.

14. The method of claim 10, further comprising determining whether the modified fuel consumption threshold value is below a minimum fuel trigger value, and performing a desulfation event in response to the modified fuel consumption threshold value being below the minimum fuel trigger value.

15. The method of claim 14, further comprising determining whether the modified fuel consumption threshold value remains below the minimum fuel trigger value after the desulfation event, and signaling a catalyst failure in response to the modified fuel consumption threshold value remaining below the minimum fuel trigger value.

16. The method of claim 10, further comprising determining whether an aggressive driving situation is present, and preventing triggering a regeneration of the $NO_x$ adsorber catalyst in response to the determining that an aggressive driving situation is present.

17. A system comprising:

a diesel engine that consumes a fuel and produces an exhaust gas;

a $NO_x$ adsorber in fluid communication with the exhaust gas for adsorbing at least a portion of the exhaust gas;

a first fuel consumption threshold value to trigger a first regeneration cycle of said $NO_x$ adsorber;

a control system to determine the decline in absorbtion efficiency of said $NO_x$ adsorber and to output a second value corresponding to the decline in absorbtion efficiency of said $NO_x$ adsorber; and a control to calculate a third fuel consumption threshold value based upon said first value and said second value, said third fuel consumption threshold value triggers a second regeneration cycle of said $NO_x$ adsorber, wherein in each of said regeneration cycles a reductant is delivered to said $NO_x$ adsorber.

18. The system of claim 17, wherein said control system comprises two sensors.

19. The system of claim 17, wherein said control system comprises an empirical table.

20. The system of claim 17, which further includes a fuel injection system for delivering the fuel into the diesel engine during engine operation, wherein said fuel injection system delivers the reductant in cylinder during each of said regeneration cycles, and wherein said reductant is defined by the fuel.

21. A method comprising:

operating a vehicle including an internal combustion engine, the internal combustion engine including an after-treatment system with a $NO_x$ adsorber catalyst;

determining a first threshold in response to a decrease in a $NO_x$ adsorber efficiency;

determining if the internal combustion engine has a fuel consumption value greater than the first threshold;

determining if the internal combustion engine is participating in an aggressive driving situation; and regenerating the $NO_x$ adsorber catalyst in response to the fuel consumption value exceeding the first threshold, only when the engine is not participating in an aggressive driving situation.

22. The method of claim 21, which further includes determining if the first threshold is below a minimum value, and performing a desulfation event in response to the first threshold being lower than the minimum value.

23. The method of claim 22, further comprising updating the first threshold in response to the performing, determining whether the first threshold remains below the minimum value after the performing the desulfation event, and signaling a catalyst failure in response to the first threshold remaining below the minimum value.

24. The method of claim 7, further comprising preventing the triggering of the regeneration of the $NO_x$ adsorber catalyst when the engine is subject to a load greater than a predetermined value.

25. The method of claim 10, further comprising determining whether the diesel engine is subject to a load greater than a predetermined value, and preventing triggering a regeneration of the $NO_x$ adsorber catalyst in response to the determining the diesel engine is subject to a load greater than the predetermined value.

26. The method of claim 17, further comprising determining whether the diesel engine is subject to a load greater than a predetermined value, and preventing the triggering of either of the first regeneration cycle and the second regeneration cycle of said $NO_x$ adsorber when the diesel engine is subject to the load greater than the predetermined value.

27. The method of claim 21, further comprising determining whether the engine is subject to a load greater than a predetermined value, and regenerating the $NO_x$ adsorber catalyst only when the engine is not subject to a load greater than the predetermined value.

* * * * *